US006119492A

United States Patent [19]

Plath

[11] Patent Number: 6,119,492

[45] Date of Patent: Sep. 19, 2000

[54] KNITTING MACHINE WITH A TIMING SIGNAL-GENERATOR DEVICE

[75] Inventor: Ernst-Dieter Plath, Albstadt, Germany

[73] Assignee: Sipra Patententwicklungs - U. Beteiligungsellschaft mbH, Albstadt, Germany

[21] Appl. No.: 09/310,394

[22] Filed: May 12, 1999

[30] Foreign Application Priority Data

May 11, 1998 [DE] Germany ..... 198 21 043

[51] Int. Cl.[7] ..... D04B 15/00

[52] U.S. Cl. ..... 66/232; 66/13

[58] Field of Search ..... 66/8, 17, 18, 231, 66/232, 237, 238, 13, 216, 218; 364/470.12

[56] References Cited

FOREIGN PATENT DOCUMENTS

| | | |
|---|---|---|
| 0 395 383 A2 | 10/1990 | European Pat. Off. . |
| 1 372 045 | 10/1974 | United Kingdom . |
| 2 201 166 | 8/1988 | United Kingdom . |

*Primary Examiner*—Danny Worrell
*Attorney, Agent, or Firm*—Michael J. Stricker

[57] ABSTRACT

A knitting machine contains at least one knitting tool carrier for knitting tools (9) with a needle distance t, an associated knitting cam assembly (12, 13), the carrier and the knitting cam assembly being moveable relative to one another and the knitting cam assembly containing a plurality of systems (I, II) lying one behind the other in the direction of movement (v) which systems having respectively a first and a second selection point, lying one behind the other in the direction of movement (v), with one electrically controllable selection member (44, 52), a timing signal-generating device (56, 60) for producing timing signals and a programme control device (53) for producing electric control signals for the control members (44, 52). According to the invention, the spacings between the first and the second selection members (44 or 52) are identical to one another and are chosen to correspond to an integer multiple of the distance t, while the spacings between the first and second selection members (44, 52) are identical in all of the systems (I, II) and are greater or smaller by a fraction x or y of the distance t than corresponds to integer multiple of the distance t. The timing signal-generating device (56, 60) is set to product a first and a second timing signal sequence containing the first or second timing signals which have temporal intervals corresponding to the distance t but which are offset relative to one another temporally by a value corresponding to the fraction x.t or y.t, one of the timing signal sequences being assigned to the first selection members (44) and the other timing signal sequence being assigned to the second selection members (52) (FIG. 8).

8 Claims, 6 Drawing Sheets

KNITTING MACHINE WITH A TIMING SIGNAL-GENERATOR DEVICE

BACKGROUND OF THE INVENTION

The invention relates to a knitting machine, especially a circular knitting machine, with at least one knitting tool carrier in which there are mounted displaceably knitting tools with a needle distance t, with a knitting cam assembly assigned to the carrier for guiding the knitting tools, the carrier and the knitting cam assembly being moveable relative to one another and the knitting cam assembly containing a plurality of systems lying one behind the other in the direction of movement, which systems having respectively a first and a second selection point, lying one behind the other in the direction of movement, with one electrically controllable selection member respectively, with a timing signal-generating device for producing timing signals in temporal intervals corresponding to the distance t and with a programme control device coupled with the timing signal-generating device for emitting electronic control signals for the control members.

Knitting machines for producing patterned knitwear are provided with a multiplicity of selection points, on which selection members are frequently arranged which are controlled by electric signals emitted from a programme control device. The selection members have the job of placing the knitting tools passing them by in different states according to pattern so that, during the normal relative movement between the knitting tool carrier carrying said tools and a knitting cam assembly assigned to said carrier, said tools can be directed into tracks or paths according to choice which e.g. are responsible for the knitting types, knitting, non-knitting (welt position) and/or tuck. If only one individual selection member is assigned to each knitting system the electric signals must be supplied to said member at the operating rate of the knitting machine or at the speed at which they are passed from the knitting tools corresponding to the respective gauge of the knitting machine, the gauge being defined as the number of needles per inch. In modern circular knitting machines, the duration of such an operating cycle is circa 1 ms.

In order to make possible a reliable control of the knitting tools the selection members, which are predominantly the control magnets of electromagnetic systems, are made to operate very precisely timewise. Otherwise, loss of control times with the consequence of faulty control occurs. Electrically or electronically controllable knitting machines have therefore as a rule timing signal-generator devices which produce, at the operating rate of the knitting machine, successive timing signals consisting of short rectangular- or needle-pulses as a rule. These are superior to the usually longer control signals produced by the programme control device in such a manner that said signals appear at exactly predetermined and always identical intervals in time on the selection members. Timing signal-generator devices of this type are known in numerous embodiments and irrespectively of the manner in which the control signals are produced for the selection members (e.g. DE-AS 15 85 181, DE 21 29 851 C3, DE 20 26 584 B2, DE-OS 20 04 194).

In order to avoid the costs of a larger number of timing signal generators it is general practice furthermore to synchronise all the selection members of one knitting machine by means of the same timing signal generator. In addition, therefore, the precondition exists that the spacings of all the selection points, measured in the direction of movement, are identical to one another and correspond to an integral multiple of the needle distance so that the knitting tools adopt on all systems exactly the same position relative to the assigned selection member of a particular system when a timing signal appears. This has the result that in this case e.g. in a circular knitting machine the number of needles is chosen such that it is divisible by the number of systems without a remainder (e.g. 1440 needles, 72 systems, spacing of the systems 1440:72=20 needles).

In a circular knitting machine which can operate with the so-called three-way technique and which makes possible a choice between knitting, tuck, non-knitting on each system (e.g. DE 40 07 253 C2) there are arranged within one system or section of a system respectively two selection points arranged one behind the other in the direction of movement, the first selection point serving e.g. for directing at will the knitting tools into the non-knitting position or tuck position and the knitting tools, brought into the tuck position, at the second selection point are left if desired in this position or are transferred into the knitting position. As a rule it is thereby possible in fact to choose the spacings between the first selection points of all the systems such that they correspond to an integer multiple of the needle distance. For the spacings between the first and second selection points of each system this requirement is by contrast frequently unfulfillable since these spacings are dependent upon e.g. the geometry of the cam assembly curves, the construction of the selection members and upon other knitting technology facts. If an attempt were made however, to choose the mentioned spacings such that they correspond to integer numbers of needles both between the first selection points of all the systems and also between the first and second selection points of each system and are identical to one another respectively then this would generally only be realiseable for a specific gauge and/or the number of needles installed in total at the circumference of a needle cylinder or the like must be chosen such that unfavourable gauges E, not corresponding to the normal values, are produced (e.g. of E=15.8 instead of the normal value E=18). This disadvantage could be indeed avoided in part by selecting the spacings between the first and second selection points to vary depending upon the gauge. However this would require an accommodation at least of the knitting cam assemblies and the electromagnetic systems made preferably in one piece to the gauge or the needle distance provided in this particular case, which is undesirable on the grounds of simple, favourably priced manufacture.

SUMMARY OF THE INVENTION

An object underlying the invention is, therefore, to design the knitting machine of the type mentioned above such that a reliable control of the knitting tools is possible.

A further object of the invention is to design the knitting machine such that a reliable control of the knitting tools is possible with a minimum number of timing signal generators.

Yet another object is to overcome the problems mentioned above and to suggest simple means by which the knitting machine can be provided with identical cam assembly arrangements and selection systems on all knitting systems without substantial deviations from gauges usual in the art.

In order to solve these and other objects of this invention the knitting machine mentioned above is characterized in that both the spacings between the first and also the spacings between the second selection points are identical in all of the systems and are greater or smaller by a fraction x or y of the distance t, where $0 \leqq x, y \leqq 1$, and in that the timing signal-generating device is set to produce a first and a second timing signal sequence containing timing signals which have temporal intervals corresponding to the distance t but which are offset relative to one another temporally by a value corresponding to the fraction x.t or y.t, the first timing signal sequence being assigned to the selection member of the first selection point and the other timing signal sequence being assigned to the selection member of the second selection point.

The invention starts off from the premise that the posed object can be achieved in that the timing signal-generator device emits in addition to the normally emitted timing signals further timing signals which are temporally offset to the first timing signals which take account of the respectively used gauge. This can be technically realised for example by using timing signal generators of a common construction and spacing these in the direction of movement between the knitting tool carrier and the knitting cam assembly while taking account of the gauge chosen in one particular case.

BRIEF DESCRIPTION OF THE DRAWINGS

The invention is explained subsequently in greater detail in the embodiments, given by way of example, in conjunction with the appended drawings which show.

DESCRIPTION OF PREFERRED EMBODIMENTS

Figure 1:
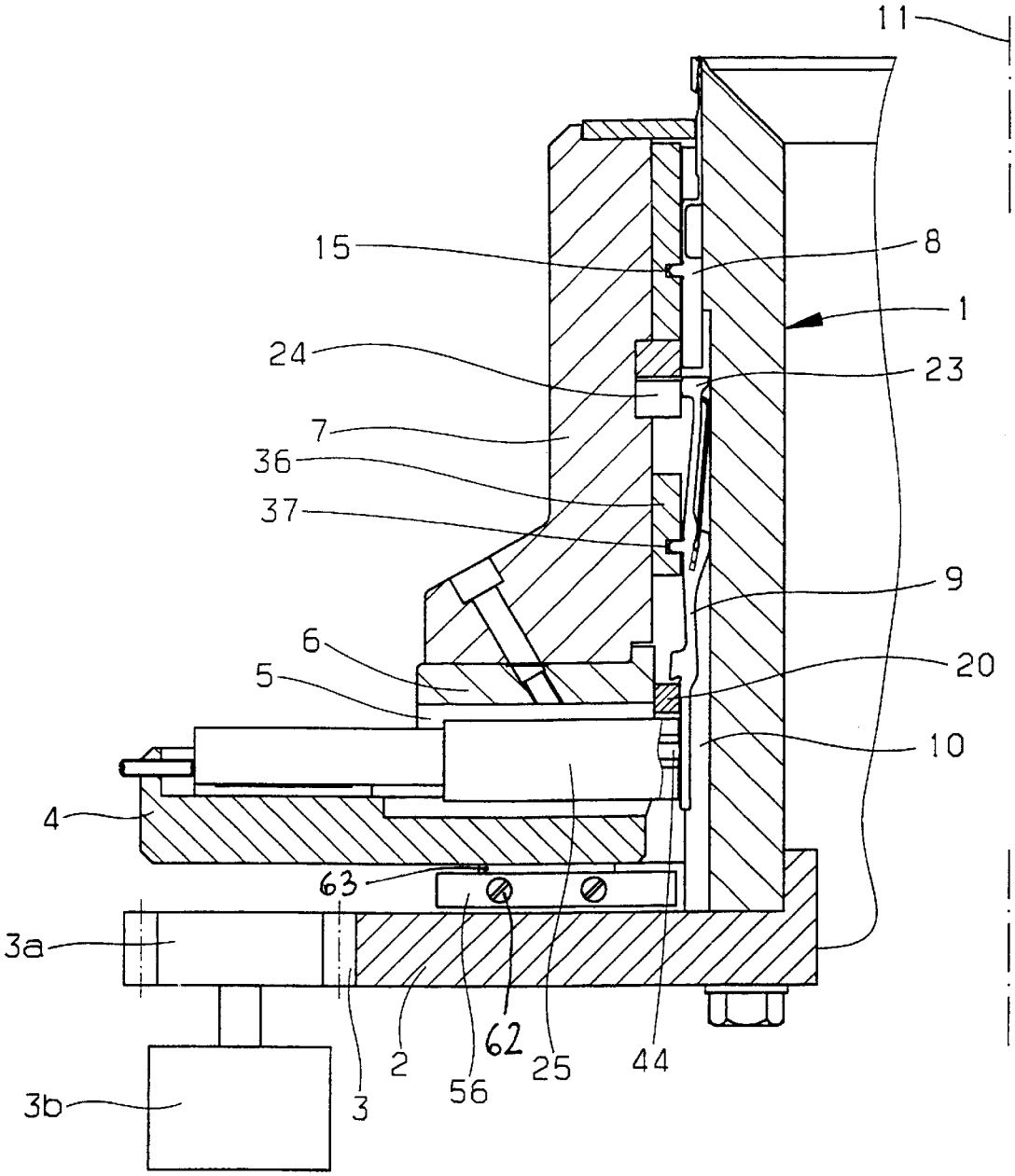
FIG. 1 a roughly schematic, radial vertical section through a circular knitting machine with a selection device.

FIG. 1 shows at least one knitting tool carrier of a circular knitting machine in the form of a needle cylinder 1 which is secured on a bearing ring 2 mounted rotatably in a machine framework. The bearing ring 2 is provided with an outer toothed drive ring 3 which is connected via a toothed wheel gear 3*a* or the like, shown only schematically, to a drive motor 3*b*. On a cam assembly plate 4 which is mounted in a stationary manner in the machine framework there is mounted by means of webs 5 a bearing ring 6 on which the cam assembly carriers 7 assigned to the individual knitting systems are mounted, the inner sides of the cam assembly carriers 7 bearing the cam assembly parts which operate on the bases of the knitting needles 8 or other knitting tools such as e.g. selector jacks, sinkers, plates or the like and the control jacks 9 assigned to the latter, the needles 8 and the control jacks 9 being arranged in grooves 10, formed by webs or the like, of the needle cylinder 1. The grooves 10 extend parallel to the axis of rotation 11 of the needle cylinder 1. The needles 8 are mounted parallel to the axis of rotation 11 displaceably in the grooves 10. The control jacks 9 are arranged underneath the needles 8 in the grooves 10 and mounted not only parallel to the axis of rotation 11 in a displaceable manner but also radially swivellable.

Figure 2:
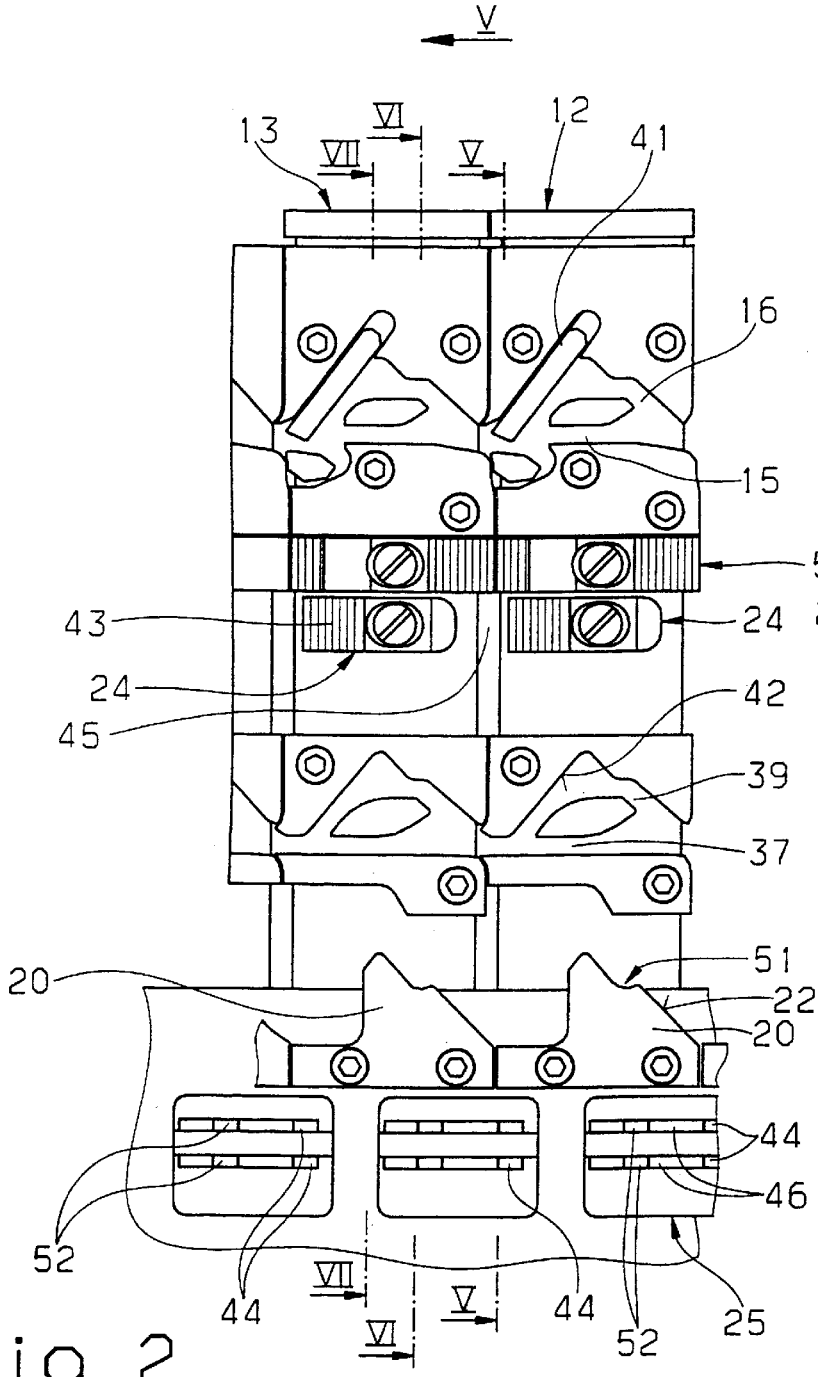
FIG. 2 the schematic front view of two adjacent cam assembly arrangements, regarded from the side of the needle cylinder of the circular knitting machine according to FIG. 1.
Figure 3:
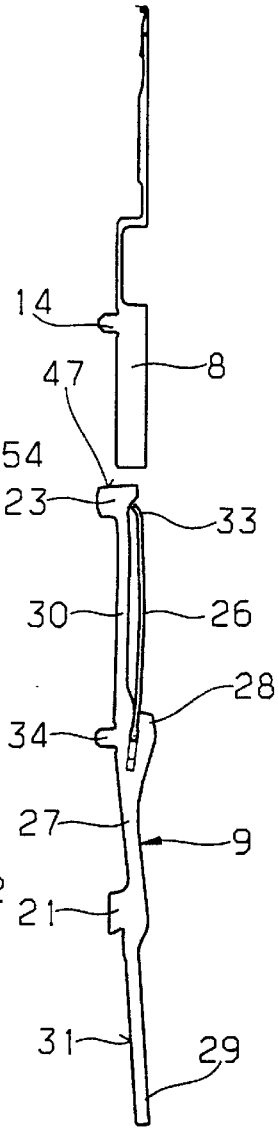
FIG. 3 a knitting needle and a control jacks, assigned to it, according to the invention.
Figure 4:
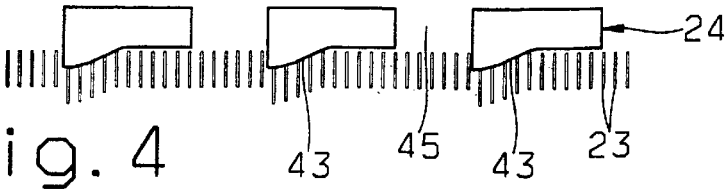
FIG. 4 a plan view of adjacent depressing cam assembly parts of the cam assembly arrangements according to FIG. 2.

As is shown especially in FIGS. 2 to 4, the circular knitting machine has a knitting cam assembly with cam assembly arrangements 12 or 13 which are assigned to the individual knitting systems or sections of the systems, two of which are shown in FIG. 2 only by way of example. In the embodiment, the cam assembly arrangement 12 has a section in an upper area, by means of which butts 14 of the needles 8 can, according to choice, be guided in a pass-through or non-knitting path or track 15 or be raised along a raising path 16 in order to pick up for example a thread at a not shown thread guide.

The cam assembly arrangement 12 has a raising part 20 for controllable raising butts 21 of the control jacks 9 underneath the paths 15, 16. The choice of whether a needle 8 should remain with its butt 14 in the pass-through path 15 or should proceed into the raising path 16 is achieved in that the control jacks 9 are swivelled in the grooves 10 such that raising butts 21 emerge either radially from the grooves 10 of the needle cylinder 1 (FIG. 1) and as a result are caught by a raising edge 22 of the raising part 20 and are raised (raising position of the control jacks 9) or are sunk radially in the grooves 10 (FIG. 5) and then pass the raising part 20 on its front-side, without being raised (pass-through or welt position of the control jacks 9). In order to prepare for the selection, the control jacks 9 have in addition a swivelling butt 23 respectively and the cam assembly arrangement 12 has a first depressing cam assembly part 24, especially shown in FIG. 4, which swivels the control jacks 9 into a first preselected position before their movement into a selection point while a selection member 25, here the control pole of a common control magnet, serves for carrying out the selection. The selection member 25 is arranged in the area of a selection point and serves for either securely holding the control jacks 9 passing said selection point or releasing them again, in which case they are swivelled away from the selection member 25 under the influence of springs 26.

Knitting machines of this type are known generally and do not require therefore to be explained to the expert in more detail (e.g. DE 35 41 171 C2 and DE 37 12 673 C1 the contents of which are hereby made the subject of the present disclosure by reference in order to avoid any repetition).

The control jack 9 according to the invention is designed essentially as a two-armed lever and provided with an oblong shaft 27, which has in a central position a bearing 28 which comprises essentially a supporting surface located on the rear side by means of which supporting surface the control jack 9, when it is arranged in assembled condition in the groove 10 (FIG. 1), is supported on the base of the groove 10 such that it can be swivelled around this supporting surface around an axis arranged perpendicular to the axis of rotation 11. From the bearing 28, there proceed a first lever arm 29, projecting downwards in the drawing and a second lever arm 30 projecting upwards. The first lever 29 has on its front side an anchor surface 31, which e.g. comprises simply a corresponding section of the front end surface of the lever arm 29, and the controllable raising butt 21 which likewise projects towards the front side and which is expediently arranged between the anchor surface 31 and the bearing 28. On the other hand, the second lever arm 30 is provided with the swivelling butt 23 which projects preferably over the front side of the control jack 9 outwards. In addition, the spring 26 is arranged such on the rear side of the second lever arm 30 that, when the control jack 9 is inserted into the pertinent groove 10 of the needle cylinder 1 (FIG. 1), said spring strives to swivel the second lever arm 30 and hence the swiveling base 23 radially out of the groove 10, and at the same time, to swivel the controllable raising butt 21 radially inwards into the groove 10. The spring 26 preferably has a curved section which forms a supporting surface 33 with its apex projecting to the rear side with which supporting surface the spring 26 can be supported on the base of the associated groove 10.

Consequently, the drawing lets it be seen that the control jack 9 is provided in the area of the bearing 28 and on its front side with an additional return butt 34 which is designed on its front side preferably in the shape of an arc of a circle. The cam assembly arrangement 12 has additional cam assembly parts in a central area corresponding to the position of the return butt 34 and thus located between the cam assembly part 20 and the depressing part 24, by means of which additional parts the return butts 34 of the control jacks 9 can be guided in a pass-through path 37 or a raising path 39 separated from the latter by a separating cam assembly part, the paths 37, 39 corresponding essentially to the paths 15, 16 (FIG. 2).

The cam assembly arrangement 13 and the cam assembly arrangements, assigned to the remaining knitting systems and not shown in FIG. 2, are correspondingly designed in the embodiment.

The mode of operation of the circular knitting machine mentioned up till now with reference to FIGS. 1 to 4 is essentially as follows:

With a rotating needle cylinder 1 and a stationary cam assembly, the knitting needles 8 and the control jacks 9 are moved in the direction of an arrow y in FIG. 2. The butts 14 of the needles 8, which have been raised in a previous cam arrangement i.e. in the direction of movement in front of the cam assembly arrangement 12, and also the return butts 34 of the associated control jacks 9 are situated, when going into the cam assembly arrangement, above the pass-through path 15 or 37 since, in the previous cam assembly arrangement 12, they were withdrawn by means of common take-down parts 41 or take-down edges 42. The butts 14, 34 of the needles, which have not been raised in the previous cam assembly arrangement, and of the control jacks 9 are likewise located at the pass-through path 15 or 37. Independently therefrom, the swivelling butts 23 of all the control jacks 9 in the end region of the previous cam assembly arrangement proceed into the operating area of the depressing cam assembly parts 24, which have depressing surfaces 43 (FIG. 4) rising radially inwards and hence all the swivelling butts 23 swivel radially inwards into the associated groove 10 of the needle cylinder 1 against the force of the springs 26. Consequently, the control jacks 9, which are mounted to swivel freely in the grooves 10, are swivelled around the bearings 28 into their raising positions such that their anchor surfaces 31 are placed in succession against the selection member 25 and from its control magnet 44 (FIG. 2) are rejected or maintained in accordance with the pattern.

Figure 5:
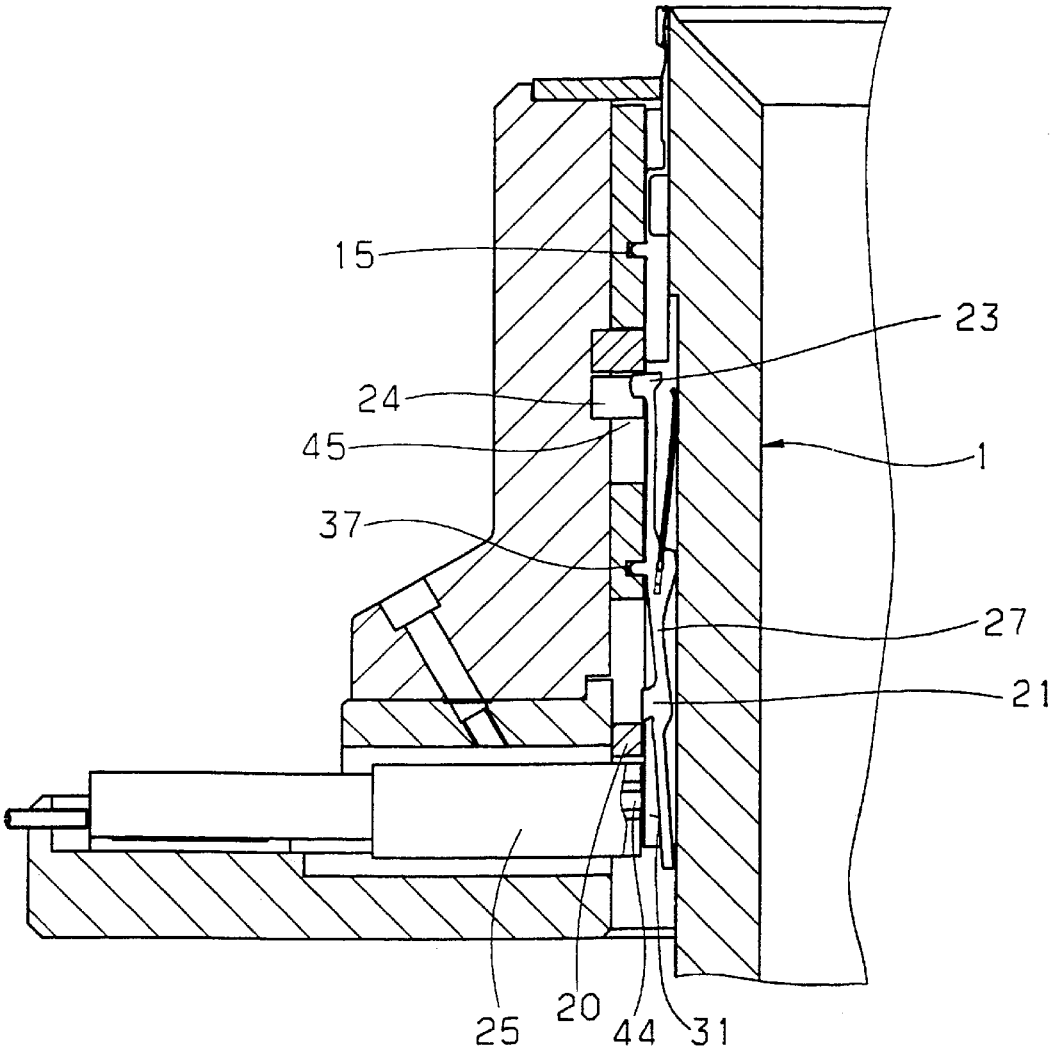
FIGS. 5 to 7 schematic, radial vertical sections, extended downwards only to the selection device, similarly to FIG. 1 along the lines V—V to VII to VII of FIG. 2.
Figure 6:
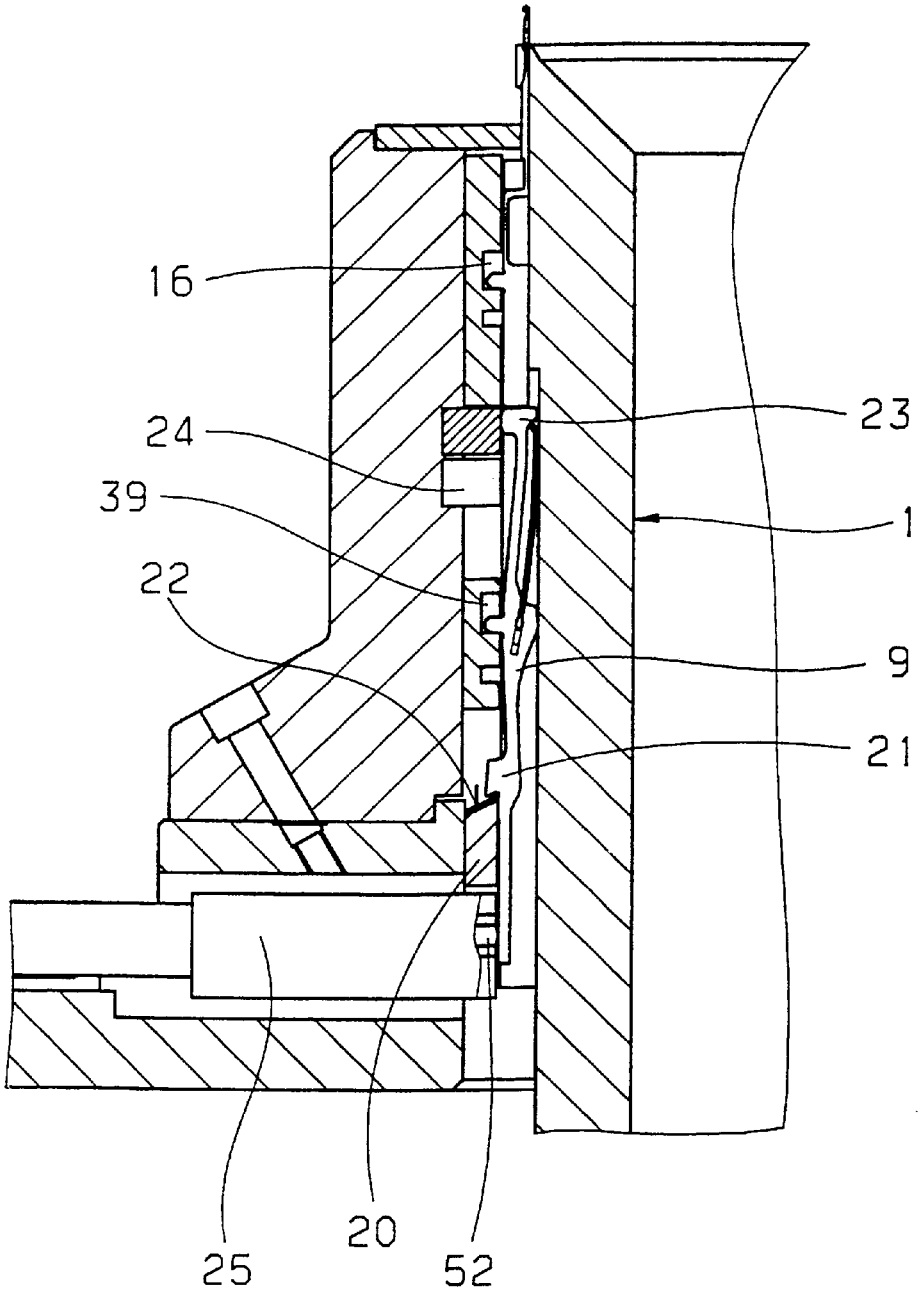
Figure 7:
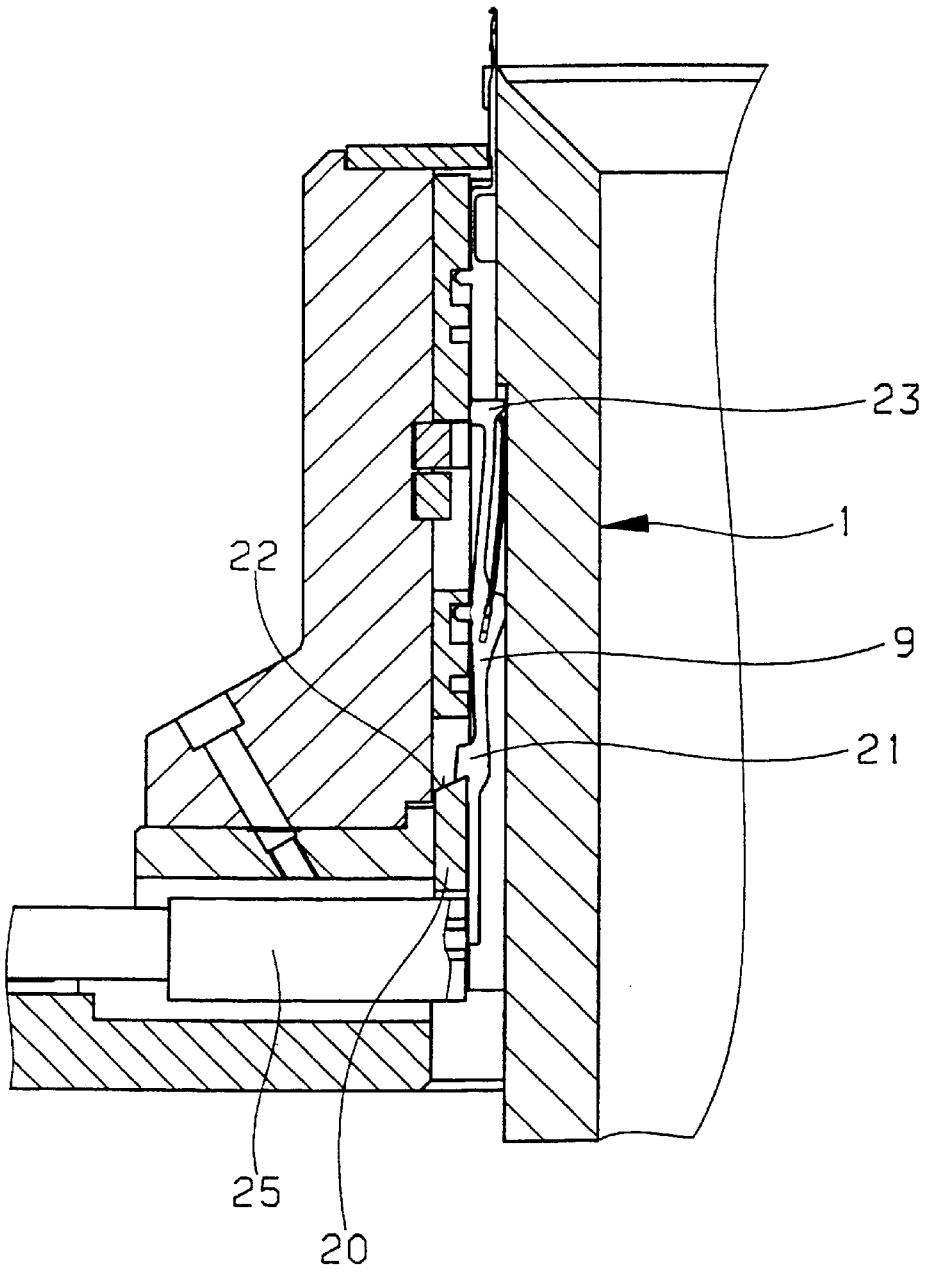

The control jacks 9 (FIG. 5) associated with the rejected anchor surfaces 31 are further on swivelled by the springs 26 around the bearings 28 into the pass-through positions until their operating butts 21 are sunk completely in the grooves 10 and thus cannot be grasped by the raising edges 22 of the cam assembly parts 20. This results above all from FIG. 5 and it is made possible in that the depressing cam assembly parts 24 have in this area a gap 45 (FIG. 4) or a recess which enables the swivelling butts 23 to be removed from the grooves 10. The section lines V—V to VII—VII for FIGS. 5 to 7 are drawn in, for the sake of clarity, in FIG. 2 in the region of the cam assembly arrangement 13 instead of in the area of the cam assembly arrangement 12, to which the present description relates. The associated operating butts 21 proceed in a further movement to the front side of the cam assembly part 20 without being raised by the latter so that the return butts 34 and the butts 14 of the needles 8 proceed into the relevant pass-through path 37 or 15.

On the other hand, the anchor surfaces 31 not rejected by the control magnets 44 are, further on in the procedure, also held firmly furthermore by holding or retaining magnets 46 (FIG. 2) arranged behind the control magnets 4 so that the control plates 9 remain in their raising positions as is shown in the section of FIG. 1, represented likewise along the section line V—V and then, further on run onto the raising edge 22 of the cam assembly part 20 with their raising butts 21, as is shown in FIG. 6. These control jacks 9 are thus raised further on along the raising edge 22. As a result, upper operating edges 47 (FIG. 3) of the swivelling butts 23 are laid on the lower edges of the associated needles 8 or other knitting tools (FIG. 6) so that the latter are raised accordingly. Both the return butts 34 and the butts 14 of the needles 8 are consequently guided first into the associated raising path 39 or 16 from which, at the end of the raising, they are withdrawn by the take-down edges 42 or take-down parts 41 back into the pass-through path 37 or 15.

A second selection point arranged behind the first selection point in the direction of rotation of the needle cylinder 1 is shown in the embodiment in the area of the section line VI—VI and in FIG. 6. Said second selection point is located in a central part of the raising edge 22 at a point 51 (FIG. 2) and is arranged such that the raising butts 21 running on the raising edge 22 are subjected there to a second selection by means of a second available control magnet 52 of the selection member 25. This is possible without a second depressing curve corresponding to the depressing curve 24 and increasing the width of the system being required because the anchor surfaces 31, located like the raising butts 21 on the same lever arm 29 and on the same side thereof, adopt their swivelling position which is required for contact with the control magnet 52 upon reaching the position 51. The raising butts 21 will thus remain either on the raising edge 22 in accordance with the pattern and then be raised into their highest position as is shown in FIG. 7 or be removed by the latter as is already known (DE 40 07 253 A1) in a similar manner for needles with swivellable butts and differently constructed selection devices. Consequently, the control jack 9 according to the invention is suited above all to quickly operating circular knitting machines with a multiplicity of e.g. 60, 64 or 72 knitting systems and for realising the so-called three-way technique with the choice non-knitting, tuck and knitting although the described control jack 9 is of course also suitable for all other knitting machines with corresponding selection devices. Thereby, the choice "knitting" corresponds to the complete raising height according to FIG. 7 and the choice "tuck" to the raising height achieved in position 51 (FIG. 2) according to FIG. 6 and the rejection of the control plates 9 occurring there.

Figure 8:
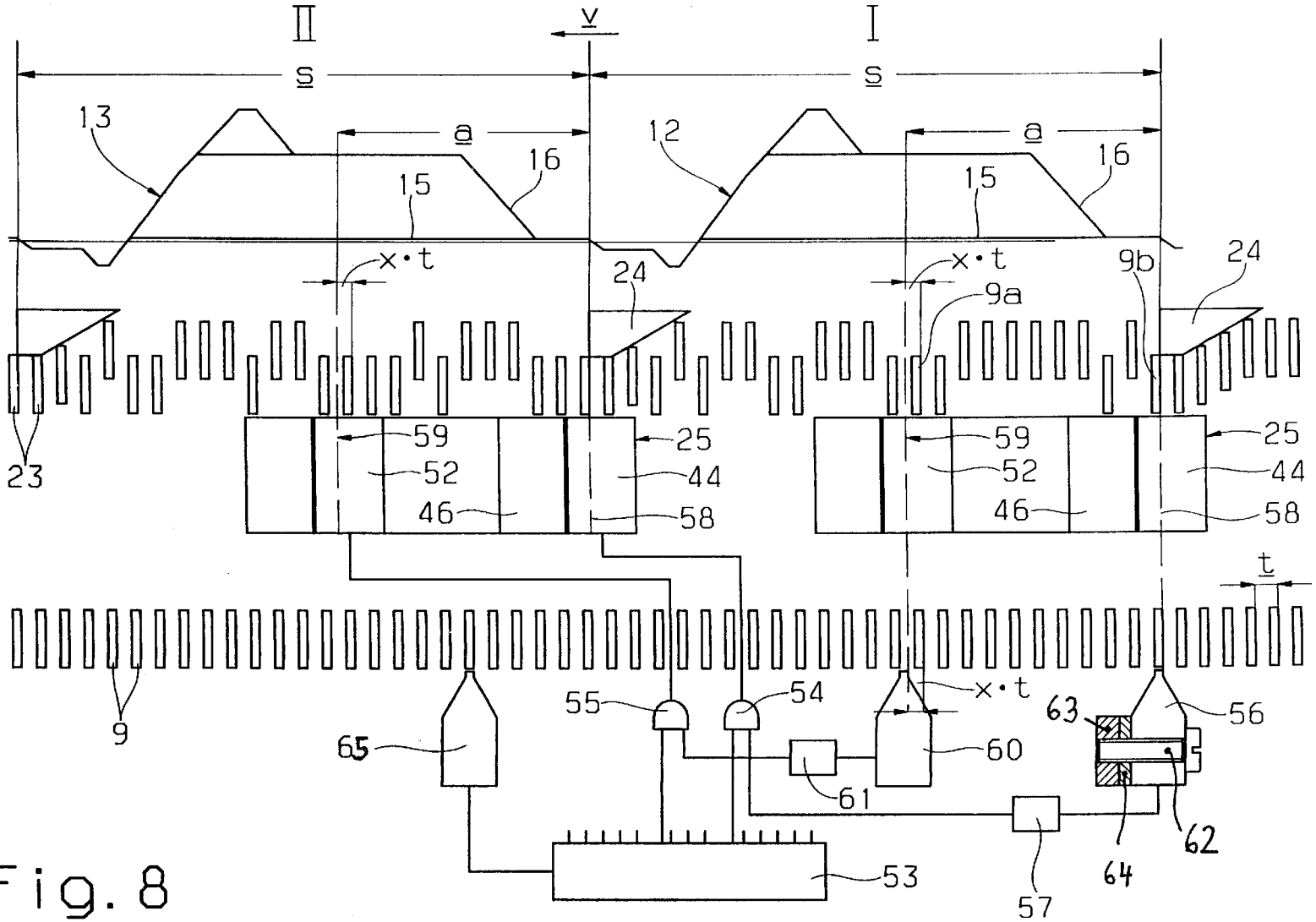
FIG. 8 a schematic front view of both cam assembly arrangements according to FIG. 2, in a greatly simplified representation, in conjunction with a timing signal-generator device according to the invention.

FIG. 8 shows the cam assembly arrangements 12 and 13, which are evident in FIG. 2, in greatly schematic form, identical parts being provided with the identical reference numbers. In particular, the non-knitting paths 15, and the expulsion paths 16, the depressing cam assembly parts 24 and the selection members 25 can be detected. In addition, a programme control device 53 is shown in conjunction with a timing signal-generator device according to the invention.

The programme control device 53 has e.g. a plurality of outputs which are connected via AND elements 54 or 55 to the control magnets 44 or 52 of the selection members 25 designed as electromagnetic systems as is shown in the left-hand part of FIG. 8. As a rule, one output of the programme control device 53 and a corresponding AND element 54, 55 is assigned respectively thereby to each control magnet 44 or 52. In the lower area of FIG. 8, the control jacks 9 which are arranged next to one another in the needle cylinder 1 are indicated schematically with rectangular boxes while, in the central part of FIG. 8, the swivelling butts 23 of the control jacks 9, which can be swivelled by the depressing cam assembly parts 24, are represented by corresponding boxes.

In order to synchronise the control signals emitted by the programme control device 53 with the rotational movement or with the operating cycle of the knitting machine the timing signal-generating device has a first timing signal generator 56 which is secured to the cam assembly plate 4 (c.f. FIG. 1 also) and which, in a known manner, scans e.g. the control jacks 9 running past said generator 56 and emits a sequence of first timing signals, the temporal location of which matches exactly the passing by of the control jacks 9 and which have temporal intervals between one another which correspond in this particular case to the available needle distance t indicated in FIG. 8 below on the right, i.e. the central spacing of the needles 8 or the control jacks in millimeters. The first timing signals in the embodiment are supplied via a pulse former 57 respectively to the second inputs of the AND units 54. As a result, information which is available e.g. in an output register of the programme control device 53 statically and in the form of "0" or "1" signals, then and only then is supplied to the control members or control magnets 44 connected to the AND elements 54, when a first timing signal appears.

Programme control devices 53 and timing signal-generator devices or timing signal generators 56 of this kind are generally known to the expert (e.g. DE-AS 15 85 181, DE-PS 21 29 851, DE 29 28 076 B2) and do not require therefore to be explained in more detail. It is understood thereby that the timing signal generator 56 can contain e.g. an electromagnetic or opto-electronic scanning component and that the first timing signals can be produced instead of by scanning the knitting tools 8, 9 also by scanning the needle cylinder webs forming the grooves 10 or by scanning with special code discs which are rotated in synchronisation with the needle cylinder 1 and if necessary temporally in accordance.

The use of an individual timing signal generator 56 presupposes that, when one of the first timing signals appears, all the control jacks 9 which are located directly in the region of a control magnet 44 adopt the same local position relative to the latter—regarded in the direction of the arrow v. If, when a timing signal appears, a control jack 9 is arranged just shortly in front of or even shortly behind that spot which is indicated optimally for an electromagnetic selection procedure and shown in FIG. 8 by a dotted line 58 within the control magnet 44, then the concomitant of this is a loss of control time, as a result of which faulty connections can arise.

In FIG. 8, the cam assembly arrangements 12 and 13 and the associated selection members 25 or 44, 52 represent one knitting system I or II respectively. The width s of a knitting system I, II in the direction f the arrow v depends upon the total number of available knitting systems. If e.g. 72 in total identical knitting systems I, II are arranged at the circumference of a needle cylinder with a diameter of 30" or a circumference of 2393.89 mm then their width s is 33.25 mm respectively.

If it is to be guaranteed that when one of the first timing signals appears there are situated opposite all available control magnets 44 an assigned control jack 9 in the correct position, the system width s on all of the systems I, II must be identical on the one hand and on the other hand in a system width of 33.25 mm there must be contained an integer number of control jacks 9 or needles 8, i.e. the system width s must correspond to an integer multiple of the distance t. If for example 24 needles 8 are accommodated per system I, II, then this implies in the example above that the distance t is circa 1.39 mm and the gauge E (1 inch or 25.4 mm) divided by the distance t is circa 18.3. On the one hand, this assures hence that the desired synchronisation can be achieved by using optimal control times with an individual timing signal generator 56 on all of the systems I, II, while at the same time the number of needles per system can be selected such that real gauges (here circa 18.3) are produced which come very close to corresponding ideal gauges (here E=18). If the number of needles per system were e.g. 37 on the other hand that would correspond to a needle distance of circa 0.9 mm and a real gauge of circa 28.2, which likewise comes very close to an ideal gauge of E=28.

If the system width s deviates from an integer number of needles or if different system widths s are provided within the same machine, then in the most unfavourable case each system I, II would need a respective timing signal generator matched to the respective system.

In FIG. 8, both the distance t and the system spacings s are drawn which with the knitting machine according to the invention are the same everywhere and correspond to a whole number (integer) multiple of the distance t. It is thereby accepted for example that a system begins at the rear edge of the depressing cam assembly part 24 and ends at the rear edge of the subsequent depressing cam assembly part 24 although of course any other point could be defined as beginning or end of a system. The rear edges of the depressing cam assembly parts 24 in the embodiment lie in addition exactly at the position of the control magnets 44, indicated in FIG. 8 by a line 58, where a control jack 9 must be arranged when a first timing signal appears so that the system width s is given respectively by means of the spacing between two lines 58. In addition, the timing signal generator 56 used in the embodiment is also arranged in FIG. 8 exactly at this point in order to indicate at which points in time the first timing signals must appear.

If it is desired that the first timing signal sequence is also suited for controlling the programme control signals supplied to the second selection members or control magnets 52, spacings a (FIG. 8) between the first and second selection points or the first and second control magnets 44 and 52 would likewise have to correspond to an integer multiple of the needle distance t. However, for numerous reasons mentioned further back this is generally not achievable.

According to the invention, the arrangement is thus affected such that in all systems I, II, the spacing a is identical and larger by a fraction x.t than corresponds to an integer multiple of the distance t with $0 \leqq x \leqq 1$ (x=0 or x=1 implying that the spacing a can by chance also be equal to an integer multiple of t, which in particular cases could indeed apply.) As FIG. 8 shows, the spacing a between the line 58 and a line 59, which offers the optimal position of the control jack 9 for the control magnet 52, is somewhat more than the 10 fold multiple of t. Therefore, whenever a control jack 9 adopts exactly its optimal position with respect to a control magnet 44 (line 58), another control jack 9 is always located just shortly in front of or shortly after the line 59 when a first timing signal appears, and as a result thereof the control times for this control jack 9 given by the duration of the programme control pulses or the timing signals can only be made effective in part or not at all. This applies even when the spacings between two successive second selection points, i.e. between two lines 59 are, in the knitting machine according to the invention, always identical to one another and identical to the system width s.

Therefore it is further proposed according to the invention that the timing signal-generator device contains a second timing signal generator 60 which emits second timing signals and which, via a second pulse former 61, is connected to the second inputs of the AND elements 55 connected to the control magnets 52. In order that the desired synchronisation for the control magnets 52 is maintained also when neither the spacings s and a are changed nor undesired needled distances or gauges are set the timing signal transmitters 56 and 60 are spaced from one another in the direction of the arrow v in such a manner that the first and second timing signal sequences are offset relative to one another in a precise temporal manner by a value corresponding to the value x.t. Since in the shown example a jack 9*a* shown in system I will only reach the line 59 or the optimal position for the control after a time interval corresponding to the value x.t which optimal position a control jack 9*b* likewise represented in system I just adopts with respect to the control magnet 44, the second timing signals in the embodiment appear later with the value x.t because only then does the control jack 9*a* also adopt its optimal position.

In the embodiment, the spacing a=14.7 mm. With the distance t=1.39 mm indicated above, this would correspond to a number of needles of 10.6 with x=0.6, whereas with the distance t=0.9 mm, the spacing a would be roughly 16.3 needles with x=0.3. Therefore, according to the needle distance t, the two timing signal generators 56, 60 would have to be adjusted relative to the control jacks 9, needles 8, needle cylinder webs or the like such that the first and second timing signals in the mentioned examples are offset to one another by time intervals corresponding to the values x=0.6 or x=0.3 needles. This can be achieved e.g. in that the spacing of the timing signal generators 56 and 60 are adjusted to x=0.3 needles (x.t=0.83 mm) or 0.6 needles (x.t=0.27 mm) plus/minus an integer number of needles. When using other distances t, these values must be correspondingly calculated and the timing signal generators 56, 60 correspondingly adjusted. It is to be understood that the production of both timing signals or timing signal sequences could also be produced by other means than those shown. In particular, by using also an individual timing signal transmitter it could be provided that two correspondingly offset timing signal transmitters arise while the offset with the value x.t is produced by purely electronic means.

In order to make possible an exact adjustment of the timing signal generator 56 in the embodiment the latter is secured with the help of attachment screws 62 to a holder 63 connected to the cam assembly plate 4 (FIGS. 1 and 8). The spacing of the timing signal generator 56 from the holder 63, measured in the direction of movement of the control jacks 9 (arrow v in FIG. 8) is adjustable thereby with the help of intermediate shims (shim discs) 64 arranged between the two according to requirement. The adjustment of the second timing signal generator 60 can be achieved in a corresponding manner.

The above explanations show that the invention is suitable in particular also for making available a knitting machine assembly, comprising at least two knitting machines which have in fact different needle distances t but can all be equipped with the same cam assembly arrangements, selection members (electromagnetic systems 44, 52) and timing signal-generating devices, only means for corresponding temporal offset of the timing signals needing to be available. Not only the cam assembly arrangements but also the electromagnetic systems designed preferably integrally can therefore be pre-manufactured completely independently of the distance t to be selected in one particular case, and kept in store.

The invention is not restricted to the described embodiment which can be altered in many ways. In particular, means other than those represented can be used for realising the three-way technique which applies both to the control jacks, used in this particular case, the cam assembly constructions and the control members and also to the programme control device and the type of timing signal generators used. In particular, there could be assigned to the timing signal-generating device in addition a further timing signal generator 65 (FIG. 8), which always emits a so-called zero-signal when the needle cylinder has completed a full revolution. In addition, it is obvious that the value x.t, which has been defined in the embodiment as a positive value, can also be defined as a negative value, the spacing a being regarded as a size which is smaller by a value y.t than corresponds to an integer multiple of the distance t. Such a consideration would however lead to the same results because in this case x+y=1 applies and from the calculated value y a corresponding value for x would also constantly result. Apart from that, one of the systems I, II could of course be omitted entirely if the gap resulting therefrom had the width s or the second selection point on one or several systems could be omitted or remain unused if the values a and s were not changed as a result. Furthermore, the invention can also be used on other knitting machines such as e.g. on circular knitting machines, which are provided exclusively or additionally with dials, on circular knitting machines with stationary knitting tool carriers and circulating cam assembly arrangements or on flat knitting machines in which the second selection point could also serve for loop transfer. In conclusion, it is understood that the various features can also be used in combinations other than those described and represented in the drawings.

It will be understood that each of the elements described above, or two or more together, may also find a useful application in other types of constructions differing from the types described above.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A knitting machine, comprising at least one knitting tool carrier; knitting tools mounted displaceably in said carrier with a distance between needles t; a knitting cam assembly assigned to said carrier for guiding said knitting tools, said carrier and said knitting cam assembly being movable relative to one another and said knitting cam assembly containing a plurality of systems lying one behind the other in a direction of movement, said systems having respectively a first and a second selection point lying one behind the other in the direction of movement; an electrically controllable selection member associated with each selection point; a timing signal-generating device for producing timing signals in temporal intervals corresponding to said distance; a program control device coupled with said timing signal-generating device for emitting electronic control signals for said selection members, both spacings between said first selection points and between said second selection points being identical to one another and having a value which corresponds to an integer multiple of the distance t, said spacings between said first and second selection points being identical in all said systems and being greater by a fraction X or smaller by a fraction Y of the distance that corresponds to an integer multiple of the distance t, where $0<X, Y\leqq 1$, said timing signal-generating device being set to produce a first and a second timing signal sequence containing timing signals which have temporal intervals corresponding to the distance t but which are offset relative to one another temporarily by a value corresponding to a fraction x-t or y-t, said first timing signal sequence being assigned to said selection member of said first selection point and said second timing signal sequence being assigned to said selection member of said second selection point.

2. A knitting machine as defined in claim 1; and further comprising means for adjusting a temporal offset of said first and second timing signals.

3. A knitting machine as defined in claim 1, wherein said timing signal-generating device has two timing signal generators which produce one of said two timing signals respectively, said timing signal generators being arranged adjustably in the direction of movement.

4. A knitting machine as defined in claim 1; and further comprising at least one second knitting tool carrier, said knitting tool carriers being exchangeable and having different needle distances t, each of said knitting tool carriers having the same cam assembly, the same selection members and the same timing signal-generating device.

5. A knitting machine as defined in claim 4, wherein each of the distances t has a same value of spacings between said selection numbers of said first and second selection points.

6. A knitting machine as defined in claim 1, wherein the knitting machine has components which are arranged so that the knitting machine is formed as a circular knitting machine.

7. A knitting machine assembly, comprising at least two knitting machines, each of said knitting machines having at least one knitting tool carrier, knitting tools mounted displaceably in said carrier with a distance between needles t, a knitting cam assembly assigned to said carrier for guiding said knitting tools, said carrier and said knitting cam assembly being movable relative to one another and said knitting cam assembly containing a plurality of systems lying one behind the other in a direction of movement, said systems having respectively a first and a second selection point lying one behind the other in the direction f movement, an electrically controllable selection member associated with each selection point, a timing signal-generating device for producing timing signals in temporal intervals corresponding to said distance, a program control device coupled with said timing signal-generating device for emitting electronic control signals for said selection members, both spacings between said first selection points and between said second selection points being identical to one another and having a value which corresponds to an integer multiple of the distance t, said spacings between said first and second selection points being identical in all said systems and being greater by a fraction X or smaller by a fraction Y of the distance that corresponds to an integer multiple of the distance t, where $0\leqq X, Y\leqq 1$, said timing signal-generating device being set to produce a first and a second timing signal sequence containing timing signals which have temporal intervals corresponding to the distance t but which are offset relative to one another temporarily by a value corresponding to a fraction x-t or y-t, said first timing signal sequence being assigned to said selection member of said first selection point and said second timing signal sequence being assigned to said selection member of said second selection point, said knitting machines having different needle distances t, all said knitting machines having the same cam assemblies, selection members and timing signal-transmitting devices.

8. A knitting machine assembly as defined in claim 7, wherein each distance t has a same value of spacings between said selection members of said first and selected selection points.

* * * * *